US006320503B1

(12) United States Patent
Dunn et al.

(10) Patent No.: US 6,320,503 B1
(45) Date of Patent: Nov. 20, 2001

(54) REMOTE CONTROL PAGING AND ORGANIZING ASSEMBLY

(76) Inventors: Vanessa Dunn; Kelli Dunn, both of 2755 Country Dr. Unit 233, Fremont, CA (US) 94538

( * ) Notice: Subject to any disclaimer, the term of this patent is extended or adjusted under 35 U.S.C. 154(b) by 0 days.

(21) Appl. No.: 09/667,024

(22) Filed: Sep. 21, 2000

(51) Int. Cl.[7] ..... G08B 1/08

(52) U.S. Cl. ..... 340/539; 340/825.36; 340/825.49; 206/320; 206/701; 206/725

(58) Field of Search ..... 340/539, 825.36, 340/825.49; 206/561, 320, 701, 718, 725

(56) References Cited

U.S. PATENT DOCUMENTS

| | | | |
|---|---|---|---|
| D. 278,102 | 3/1985 | Wagner, Jr. . | |
| D. 396,384 | 7/1998 | Slaten et al. . | |
| 3,433,364 | 3/1969 | Chen . | |
| 3,850,398 | 11/1974 | Kantor . | |
| 4,739,887 | 4/1988 | Beach . | |
| 5,598,143 | 1/1997 | Wentz . | |
| 5,790,021 * | 8/1998 | Mickel et al. | 340/539 |

* cited by examiner

*Primary Examiner*—Daryl Pope

(57) ABSTRACT

A remote control paging and organizing assembly for effectively locating and storing remote controls. The remote control paging and organizing assembly includes a remote control, a remote housing base and a base unit. The remote control is coupled to the remote housing base. The remote housing base has an electronic receiving paging circuit therein. The base unit has at least one opening extending inwardly from a front face of the base unit and across a top surface of the base unit to form a vertical remote control storage slot. The remote control storage slot is for holding an associated remote control and remote housing base. Each remote control storage slot has an associated electronic transmitting paging circuit therein for communicating with an associated remote housing base.

12 Claims, 3 Drawing Sheets

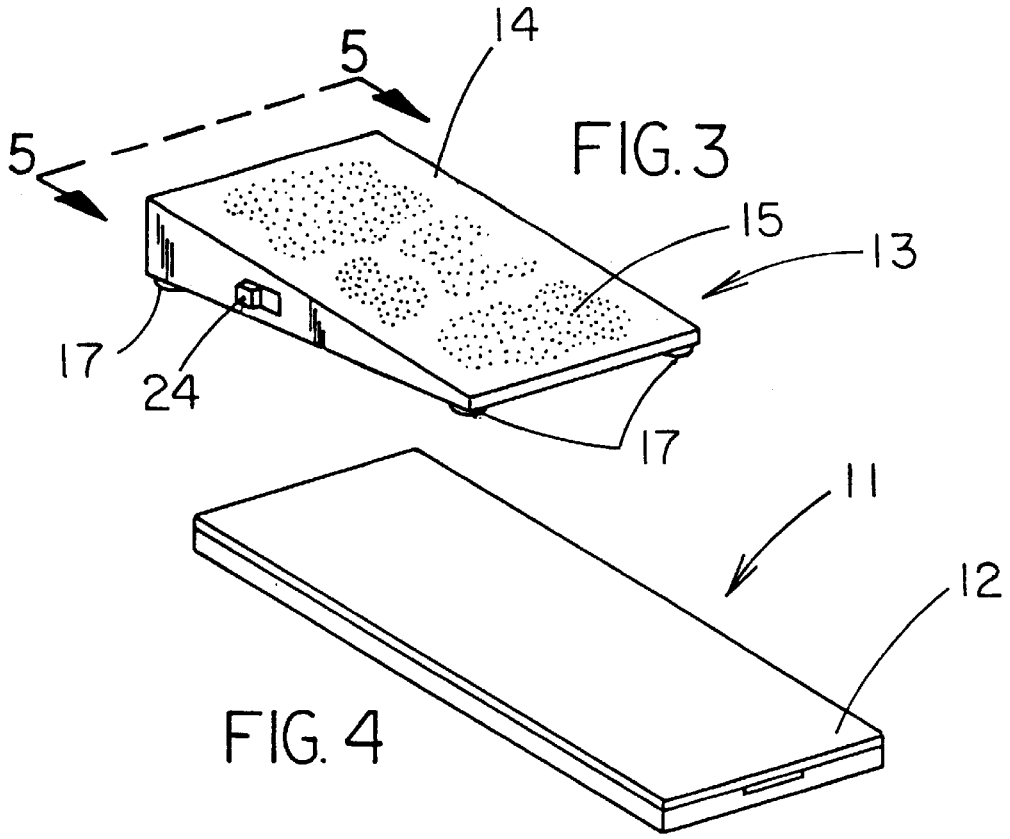
FIG. 3
FIG. 4
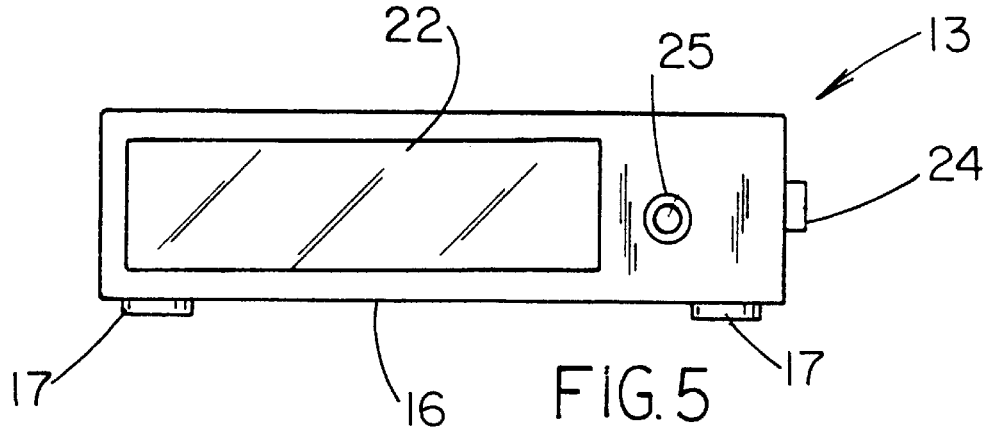
FIG. 5

REMOTE CONTROL PAGING AND ORGANIZING ASSEMBLY

BACKGROUND OF THE INVENTION

1. Field of the Invention

The present invention relates to remote control location devices and more particularly pertains to a new remote control paging and organizing assembly for effectively locating and storing remote controls.

2. Description of the Prior Art

The use of remote control location devices is known in the prior art. More specifically, remote control location devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,598,143; U.S. Pat. No. 4,739,887; U.S. Pat. No. Des. 278,102; U.S. Pat. No. Des. 396,384; U.S. Pat. No. 3,850,398; and U.S. Pat. No. 3,433,364.

While these devices fulfill their respective, particular objectives and requirements, the aforementioned patents do not disclose a new remote control paging and organizing assembly. The inventive device includes a remote housing base and a base unit. An existing remote control is couplable to the remote housing base. The remote housing base has an electronic receiving paging circuit therein. The base unit has at least one opening extending inwardly from a front face of the base unit and across a top surface of the base unit to form a vertical remote control storage slot. The remote control storage slot is for holding an associated remote control and remote housing base. Each remote control storage slot has an associated electronic transmitting paging circuit therein for communicating with an associated remote housing base.

In these respects, the remote control paging and organizing assembly according to the present invention substantially departs from the conventional concepts and designs of the prior art, and in so doing provides an apparatus primarily developed for the purpose of effectively locating and storing remote controls.

SUMMARY OF THE INVENTION

In view of the foregoing disadvantages inherent in the known types of remote control location devices now present in the prior art, the present invention provides a new remote control paging and organizing assembly construction wherein the same can be utilized for effectively locating and storing remote controls.

The general purpose of the present invention, which will be described subsequently in greater detail, is to provide a new remote control paging and organizing assembly apparatus and method which has many of the advantages of the remote control location devices mentioned heretofore and many novel features that result in a new remote control paging and organizing assembly which is not anticipated, rendered obvious, suggested, or even implied by any of the prior art remote control location devices, either alone or in any combination thereof.

To attain this, the present invention generally comprises a remote control, a remote housing base and a base unit. The remote control is coupled to the remote housing base. The remote housing base has an electronic receiving paging circuit therein. The base unit has at least one opening extending inwardly from a front face of the base unit and across a top surface of the base unit to form a vertical remote control storage slot. The remote control storage slot is for holding an associated remote control and remote housing base. Each remote control storage slot has an associated electronic transmitting paging circuit therein for communicating with an associated remote housing base.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new remote control paging and organizing assembly apparatus and method which has many of the advantages of the remote control location devices mentioned heretofore and many novel features that result in a new remote control paging and organizing assembly which is not anticipated, rendered obvious, suggested, or even implied by any of the prior art remote control location devices, either alone or in any combination thereof.

It is another object of the present invention to provide a new remote control paging and organizing assembly that may be easily and efficiently manufactured and marketed.

It is a further object of the present invention to provide a new remote control paging and organizing assembly that is of a durable and reliable construction.

An even further object of the present invention is to provide a new remote control paging and organizing assembly which is susceptible of a low cost of manufacture with regard to both materials and labor, and which accordingly is then susceptible of low prices of sale to the consuming public, thereby making such remote control paging and organizing assembly economically available to the buying public.

Still yet another object of the present invention is to provide a new remote control paging and organizing assembly which provides in the apparatuses and methods of the prior art some of the advantages thereof, while simultaneously overcoming some of the disadvantages normally associated therewith.

Still another object of the present invention is to provide a new remote control paging and organizing assembly for effectively locating and storing remote controls.

Yet another object of the present invention is to provide a new remote control paging and organizing assembly which includes a remote control, a remote housing base and a base unit. The remote control is coupled to the remote housing base. The remote housing base has an electronic receiving paging circuit therein. The base unit has at least one opening extending inwardly from a front face of the base unit and across a top surface of the base unit to form a vertical remote control storage slot. The remote control storage slot is for holding an associated remote control and remote housing base. Each remote control storage slot has an associated electronic transmitting paging circuit therein for communicating with an associated remote housing base.

Still yet another object of the present invention is to provide a new remote control paging and organizing assembly that eliminates the clutter of multiple remotes, ashtrays, coasters for cups and TV guides on coffee tables.

Even still another object of the present invention is to provide a new remote control paging and organizing assembly that is easy to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic exploded view of the remote housing base of the present invention.

FIG. 4 is a schematic perspective back view of the remote control of the present invention.

FIG. 5 is a schematic side view of the remote housing base of the present invention, illustrating the light and battery port.

DESCRIPTION OF THE PREFERRED EMBODIMENT

Figure 1:
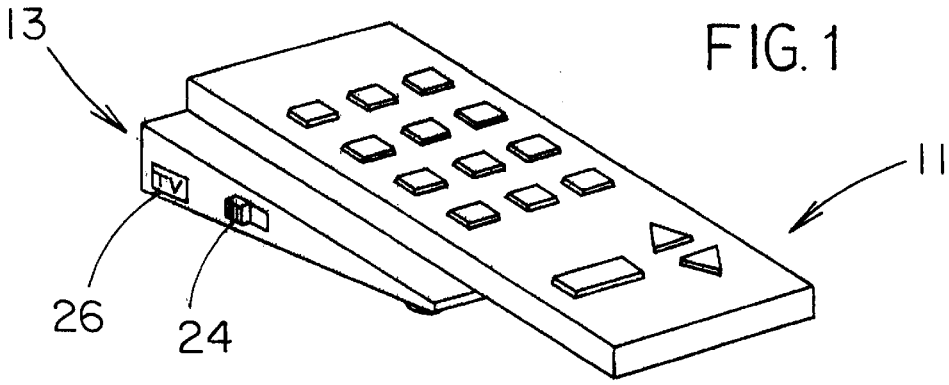
FIG. 1 is a schematic perspective view of a remote control coupled to the remote housing base according to the present invention.
Figure 2:
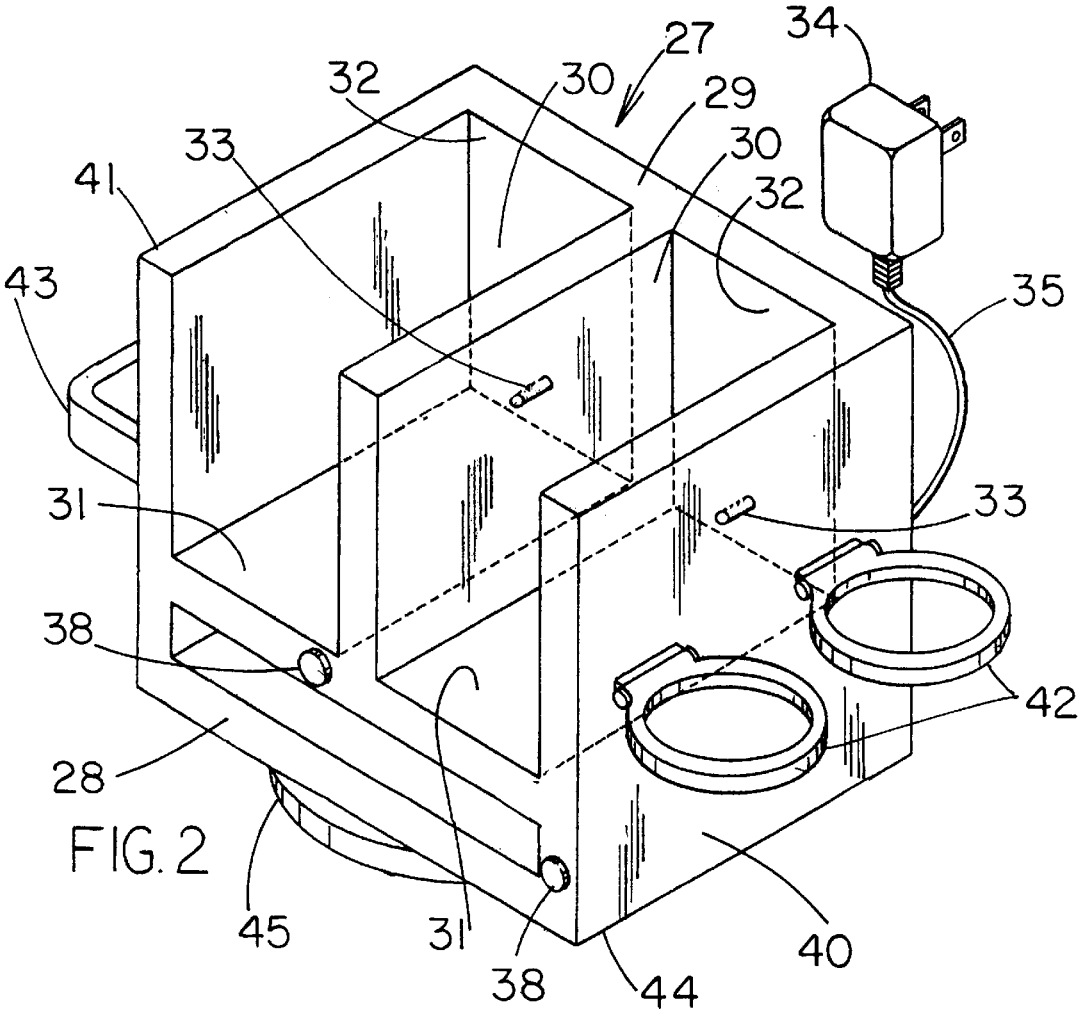
FIG. 2 is a schematic perspective view of the base unit of the present invention.
Figure 6:
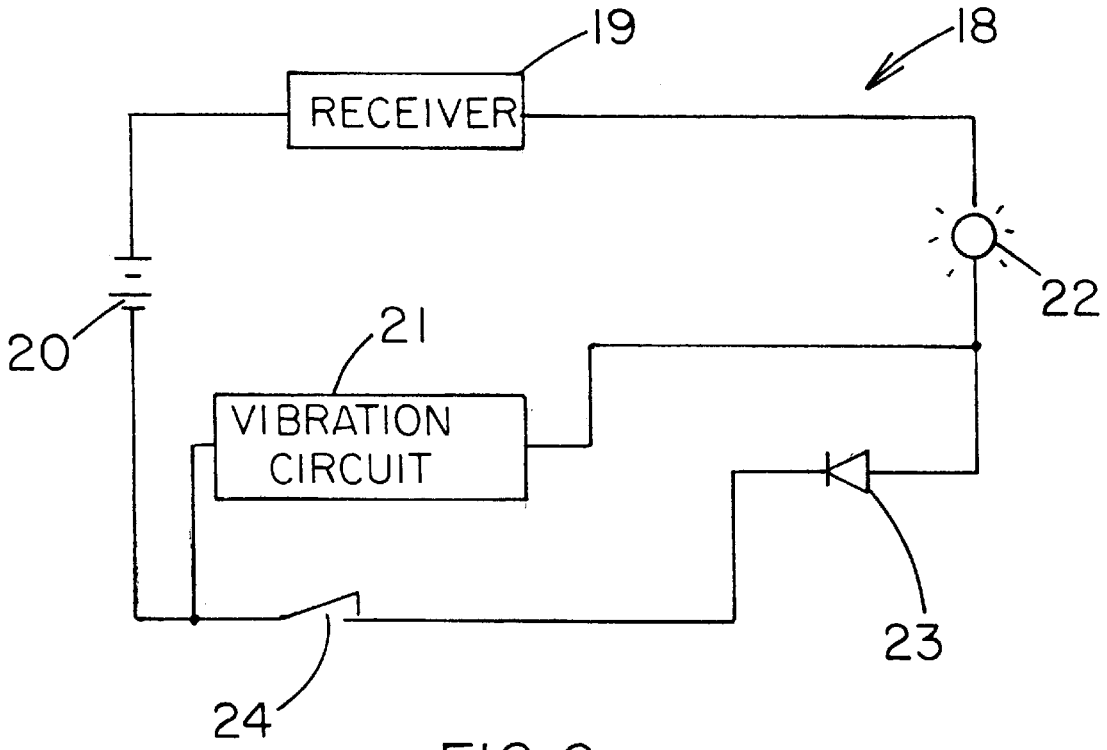
FIG. 6 is a schematic block diagram of the electronic receiving paging circuit in the remote housing base of the present invention.
Figure 7:
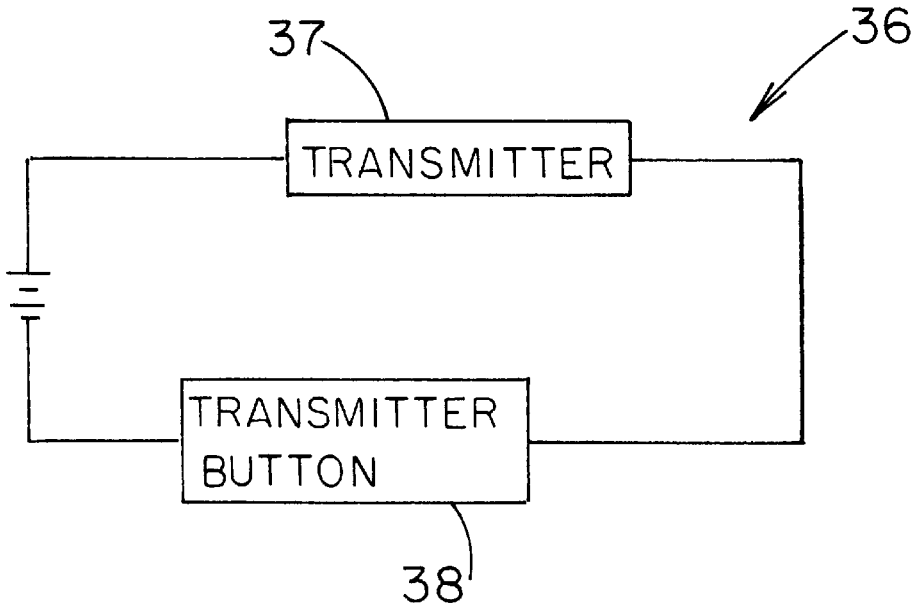
FIG. 7 is a schematic block diagram of the electronic transmitting paging circuit associated with each storage slot of the present invention.

With reference now to the drawings, and in particular to FIGS. 1 through 7 thereof, a new remote control paging and organizing assembly embodying the principles and concepts of the present invention and generally designated by the reference numeral 10 will be described.

As best illustrated in FIGS. 1 through 7, the remote control paging and organizing assembly 10 generally comprises a remote control 11 that has a back side 12. The remote control paging and organizing assembly 10 also has a remote housing base 13 that is substantially wedged shaped. The remote housing base 13 has a first surface 14. The first surface 14 has an adhesive material 15 attached thereon. The adhesive material 15 couples the back side 12 of the remote control 11 to the first surface 14 of the remote housing base 13.

The remote housing base 13 further has a bottom surface 16. A plurality of substantially round support feet 17 are coupled to the bottom surface 16 of the remote housing base 13. The support feet 17 are designed to engage a support surface upon which the remote housing base 13 is placed.

The remote housing base 13 has an electronic receiving paging circuit 18 therein. The electronic receiving paging circuit 18 comprising a receiver 19, a battery 20, a vibration circuit 21, a light 22 and a speaker 23. The receiver 19 is for receiving a signal. The vibration circuit 21 vibrates the remote housing base 13 when the receiver 19 receives a signal. The light 22 activates when the receiver 19 receives a signal. The speaker 23 produces a sound when the receiver 19 receives a signal. The battery 20 provides power to the electronic receiving paging circuit 18.

The remote housing base 13 also has a remote housing switch 24. The remote housing switch 24 is operationally coupled to the vibration circuit 21 and the speaker 23 for permitting selection of the vibration circuit 21 or the speaker 23 when the receiver 19 receives a signal. In addition, the remote housing base has a battery port 25. The battery port 25 is in electrical communication with the battery 20 for facilitating the charging of the battery 20.

The remote housing base 13 further has a label 26 thereon. The label 26 is markable with indicia corresponding to a device operated by an associated remote control 11 that is coupled to the remote housing base 13 by the adhesive material 15.

The remote control paging and organizing assembly 10 further has a base unit 27. The base unit has a front face 28 and a top surface 29. The base unit has at least one opening extending inwardly from the front face 28 of the base unit 27 and across the top surface 29 of the base unit 27 to form a vertical remote control storage slot 30. The remote storage slot 30 is designed for holding an associated remote control 11. Each remote control storage slot 30 has a supporting surface 31. The supporting surface 31 is designed for supporting a remote control 11 and remote housing base 13 when the remote control 11 and remote housing base 13 are placed in the remote control storage slot 30.

Each remote control storage slot 30 has a back surface 32 that extends between the supporting surface 31 and the top surface 29 of the base unit 27. Each back surface 32 has a charger outlet 33 extending therefrom. The charger outlet 33 is used for selectively engaging a battery port 25 in an associated remote housing base 13. The charger outlet 33 is electrically coupled to an A/C charger 34 by an AC cord 35. Thus, the battery 20 in the remote housing base 13 is charged when the charger outlet 33 is engaged with the battery port 25 and the A/C charger 34 is plugged into an electrical outlet.

Each storage slot 30 has an associated electronic transmitting paging circuit 36 therein for communicating with an electronic receiving paging circuit 18 in an associated remote housing base 13. The electronic transmitter paging circuit comprises a transmitter 37, an AC cord 35 and a transmitter button 38. The AC cord 35 is for supplying power to the transmitter 37 and a transmitter button 38 for activating the transmitter 37. The transmitter 37 is set at a frequency that corresponds to a frequency that activates a receiver 19 in an associated remote housing base 13.

The base unit 27 has a generally horizontal slot 39 for storing magazines. The horizontal slot 39 is positioned in the front face 28 of the base unit 27 under the remote control storage slots 30. The base unit also has a first side member 40 and a second side member 41. A plurality of cup holders 42 are pivotally coupled to the first side member 40. In addition, an ash tray 43 is coupled to the second side member 41.

The base unit 27 also has a bottom surface 44. A swivel stand 45 extends from the bottom surface 44 of the base unit 27. The swivel stand 45 is rotatably coupled to the bottom surface 44 of the base unit 27. Thus the base unit 27 is free to rotate relative to the swivel stand 45.

In use, a remote control 11 is coupled to a remote housing base 13. The remote housing switch 24 on the remote housing base 13 is then positioned to either activate the vibration circuit 21 or the speaker 23. If the remote control 11 is not stored in the remote control storage slot 30 and cannot be found, the user simply pushes the transmitter button 38 on the base unit 27 thereby causing the electronic transmitter paging circuit 36 to send a signal. Upon receiving the signal sent by the electronic transmitter paging circuit 36, the electronic receiving paging circuit 18 in an associated remote housing base 13 alerts the user where the remote control 11 is located.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A remote control paging and organizing assembly comprising:

a remote control having a back side;

a remote housing base being substantially wedged shaped, said remote housing base having a first surface, said first surface having an adhesive material thereon for facilitating coupling of said back side of said remote control to said first surface;

said remote housing base further having a bottom surface, a plurality of substantially round support feet being coupled to said bottom surface of said remote housing base such that said remote housing base is adapted for being supported by a support surface upon which said support feet are positioned;

said remote housing base having an electronic receiving paging circuit therein, said electronic receiving paging circuit comprising a receiver for receiving a signal, a battery for providing power to said electronic receiving paging system, a vibration circuit for vibrating said remote housing base when a signal is received, a light for lighting up when a signal is received and a speaker for producing a sound when a signal is received;

said remote housing base having a remote housing switch, said remote housing switch being operationally coupled to said vibration circuit and said speaker for permitting selection of said vibration circuit or said speaker when said receiver receives a signal;

said remote housing base also having a battery port, said battery port being in electrical communication with said battery for facilitating the charging of said battery;

said remote housing base further having a label for selectively coupling to said remote housing base, said label being markable with indicia corresponding to a device operated by an associated remote control that is positionable on said remote housing base proximate said label;

a base unit having a front face and a top surface;

said base unit having at least one opening extending inwardly from said front face of said base unit and across said top surface of said base unit to form a vertical remote control storage slot for holding an associated remote control and remote housing base;

each said remote control storage slot having a supporting surface for supporting a remote control and remote housing base placed in said remote control storage slot;

each said remote control storage slot having a back surface extending between said supporting surface and said top surface, each said back surface having a charger outlet extending therefrom for selectively engaging a battery port in an associated remote housing base, said charger outlet being electrically coupled to an A/C charger by an AC cord whereby said battery in said remote housing base is chargeable when said charger outlet is engaged with said battery port and said A/C charger is plugged into an electrical outlet;

each said storage slot having an associated electronic transmitting paging circuit therein for communicating with an associated remote housing base, said electronic transmitting paging circuit comprising a transmitter for transmitting a signal to a receiver in an associated remote housing base, an AC cord for supplying power to said transmitter and a transmitter button for activating said transmitter, said transmitter being set at a frequency that corresponds to a frequency that activates a receiver in an associated remote housing base;

said base unit having a generally horizontal slot for storing magazines, said horizontal slot being positioned in said front face of said base unit under said remote control storage slots;

said base unit having a first side member and a second side member, a plurality of cup holders being pivotally coupled to said first side member, an ash tray being coupled to said second side member; and the base unit having a bottom surface, a swivel stand extending from said bottom surface of said base unit, said swivel stand being rotatably coupled to the bottom surface of the base unit whereby said base unit is free to rotate relative to said swivel stand.

2. A remote control paging and organizing assembly comprising:

a remote control having a back side;

a remote housing base having a first surface, said first surface having an adhesive material thereon for facilitating coupling of said back side of said remote control to said first surface;

said remote housing base having an electronic receiving paging circuit therein, a base unit having a front face and a top surface;

a base unit having at least one opening extending inwardly from said front face of said base unit and across said top surface of said base unit to form a vertical remote control storage slot for holding an associated remote control and remote housing base;

each said remote control storage slot having a supporting surface for supporting a remote control and remote housing base placed in the remote control storage slot;

each said remote control storage slot having an associated electronic transmitting paging circuit therein for communicating with an associated remote housing base; and said remote housing base further having a label for selectively coupling to said remote housing base, said label being markable with indicia corresponding to a device operated by an associated remote control that is positionable on said remote housing base proximate said label.

3. The remote control paging and organizing assembly of claim 1 further comprising:

said remote housing base being substantially wedged shaped.

4. The remote control paging and organizing assembly of claim 1 further comprising:

said remote housing base further having a bottom surface; and a plurality of substantially round support feet being coupled to said bottom surface of said remote housing base such that said remote housing base is adapted for being supported by a support surface upon which said support feet are positioned.

5. The remote control paging and organizing assembly of claim 1 further comprising:

said electronic transmitting paging circuit comprising a transmitter for transmitting a signal to a receiver in an associated remote housing base, an AC cord for supplying power to said transmitter and a transmitter button for activating said transmitter, said transmitter being set at a frequency that corresponds to a frequency that activates a receiver in an associated remote housing base.

6. The remote control paging and organizing assembly of claim 1 further comprising:

said base unit having a generally horizontal slot for storing magazines, said horizontal slot being positioned in said front face of said base unit under said remote control storage slots.

7. The remote control paging and organizing assembly of claim 1 further comprising:

said base unit having a first side member, a plurality of cup holders being pivotally coupled to said first side member.

8. The remote control paging and organizing assembly of claim 1 further comprising:

said base unit having a second side member, an ash tray being coupled to said second side member.

9. The remote control paging and organizing assembly of claim 1 further comprising:

said base unit having a bottom surface, a swivel stand extending from said bottom surface of said base unit, said swivel stand being rotatably coupled to said bottom surface of said base unit whereby said base unit is free to rotate relative to said swivel stand.

10. A remote control paging and organizing assembly comprising:

a remote control having a back side;

a remote housing base having a first surface, said first surface having an adhesive material thereon for facilitating coupling of said back side of said remote control to said first surface;

said remote housing base having an electronic receiving paging circuit therein, a base unit having a front face and a top surface;

a base unit having at least one opening extending inwardly from said front face of said base unit and across said top surface of said base unit to form a vertical remote control storage slot for holding an associated remote control and remote housing base;

each said remote control storage slot having a supporting surface for supporting a remote control and remote housing base placed in the remote control storage slot;

each said remote control storage slot having an associated electronic transmitting paging circuit therein for communicating with an associated remote housing base;

said electronic receiving paging circuit comprising a receiver for receiving a signal, a battery for providing power to said electronic receiving paging circuit, a vibration circuit for vibrating said remote housing base when a signal is received, a light for lighting when a signal is received and a speaker for producing a sound when a signal is received.

11. The remote control paging and organizing assembly of claim 10 further comprising:

said remote housing base having a remote housing switch, said remote housing switch being operationally coupled to said vibration circuit and said speaker for permitting selection of said vibration circuit or said speaker when said receiver receives a signal.

12. The remote control paging and organizing assembly of claim 10 further comprising:

said remote housing base also having a battery port, said battery port being in electrical communication with said battery for facilitating the charging of said battery;

each said remote control storage slot having a back surface extending between said supporting surface and said top surface;

each said back surface having a charger outlet extending therefrom for selectively engaging a battery port in an associated remote housing base, said charger outlet being electrically coupled to an A/C charger by a cord whereby said battery in said remote housing base is chargeable when said charger outlet is engaged with said battery port and said A/C charger is plugged into an electrical outlet.

* * * * *